US005579813A

United States Patent [19]

Watts

[11] Patent Number: 5,579,813

[45] Date of Patent: Dec. 3, 1996

[54] SELF-TRIGGERING INFLATABLE BALLOON DEVICE

[76] Inventor: Bruce D. Watts, 6911 Palmer Rd., Greens Fork, Ind. 47345

[21] Appl. No.: 411,499

[22] Filed: Mar. 28, 1995

[51] Int. Cl.[6] ..... A63H 27/10

[52] U.S. Cl. ..... 141/317; 141/313; 116/DIG. 9; 40/412; 446/220

[58] Field of Search ..... 141/10, 317, 4, 141/67, 114, 197, 313, 314, 346, 348; 116/210, DIG. 8, DIG. 9; 446/220–226, 148; 40/214, 215, 412; 137/223

[56] References Cited

U.S. PATENT DOCUMENTS

| | | | |
|---|---|---|---|
| 4,433,638 | 2/1984 | Ashline | 116/210 |
| 4,787,575 | 11/1988 | Stewart | 116/210 X |
| 4,800,835 | 1/1989 | Mears | 116/210 |
| 4,903,958 | 2/1990 | DiCarlo et al. | 116/210 X |
| 5,083,771 | 1/1992 | Tyner | 116/DIG. 9 X |
| 5,095,845 | 3/1992 | Murphy | 116/210 |
| 5,234,726 | 8/1993 | Dahan | 446/220 |
| 5,399,122 | 3/1995 | Slater | 116/210 X |

*Primary Examiner*—J. Casimer Jacyna

*Attorney, Agent, or Firm*—Woodard, Emhardt, Naughton Moriarty & McNett

[57] ABSTRACT

A self-triggering inflatable balloon device. In a preferred embodiment, the device comprises a cylinder of compressed gas having an actuating valve thereon. The other end of the actuating valve is coupled to a deflated balloon. The cylinder, valve and deflated balloon are secured to the interior of a box having a hinged lid. An actuating member of the valve is coupled to the box lid such that the valve is opened when the box lid is raised. Upon opening of the box lid, therefore, the actuating valve is opened and the balloon is automatically inflated with the gas from the compressed gas cylinder. The device may be given as a gift wrapped present or mailed to a friend, and will produce a surprise when opened.

9 Claims, 3 Drawing Sheets

SELF-TRIGGERING INFLATABLE BALLOON DEVICE

TECHNICAL FIELD OF THE INVENTION

The present invention generally relates to inflatable balloons, and more particularly to a self-triggering inflatable balloon device.

BACKGROUND OF THE INVENTION

Balloons are commonly used as festive decorations to signify the celebration of some important event or anniversary. Balloons are universally recognized as a sign of happiness and celebration. It is therefore commonplace to purchase one or more balloons to give as a gift when celebrating a significant occasion.

Helium-filled balloons and other balloons inflated with gases that make them buoyant under normal atmospheric conditions are by far the most popular type of balloon. Such balloons are by perceived necessity sold to consumers already inflated with the buoyant gas because most consumers do not possess means to inflate them. These inflated balloons have a limited lifespan, owing to the tendency of the balloons to deflate over time as the buoyant gas leaks from the interior of the balloon to the exterior, either through the inflation orifice or through the balloon material itself. Also, inflated balloons are very bulky and fragile, exhibiting explosive decompression if damaged in any way.

Because of the limited life span and the bulky and fragile nature of inflated balloons, it is not practical to send them through the mail. The cost of mailing is prohibitive due to the size of the balloon, and the odds of the balloon arriving at its destination inflated are small, it being likely that the balloon will deflate during transit due to leakage or damage. For the same reasons, it is generally not practical to giftwrap balloons and give them as presents.

Because of these limitations in present balloon technology, it is generally impractical or infeasible to send an inflated balloon to someone through the mail or to give balloons as gift wrapped presents due to their bulky nature and due to the delay between sending or wrapping and receipt. There is therefore a need for a device that will allow an inflated balloon to be given to a person at an indefinite time after purchasing the balloon. The present invention is directed toward meeting this need.

SUMMARY OF THE INVENTION

The present invention relates to a self-triggering inflatable balloon device. In a preferred embodiment, the device comprises a cylinder of compressed gas having an actuating valve thereon. The other end of the actuating valve is coupled to a deflated balloon. The cylinder, valve and deflated balloon are secured to the interior of a box having a hinged lid. An actuating member of the valve is coupled to the box lid such that the valve is opened when the box lid is raised. Upon opening of the box lid, therefore, the actuating valve is opened and the balloon is automatically inflated with the gas from the compressed gas cylinder. The device may be given as a gift wrapped present or mailed to a friend, and will produce a surprise when opened.

In one form of the invention a self-triggering inflatable balloon device is disclosed, comprising an enclosure having an openable portion; a container enclosed within the enclosure, the container holding a quantity of compressed gas; an inflatable balloon enclosed within the enclosure; and a triggering mechanism coupled to the openable portion and operable to cause the compressed gas to flow into the balloon when the openable portion is opened, thereby causing the balloon to inflate.

In another form of the invention a self-triggering inflatable balloon device is disclosed, comprising an enclosure having an openable portion; a container enclosed within the enclosure, the container holding a quantity of compressed gas; an inflatable balloon enclosed within the enclosure; a valve coupled to the container and to the balloon, the valve having a closed state and an open state, wherein an interior of the container is placed in fluid communication with an interior of the balloon when the valve is in the open state; and a triggering mechanism coupled to the openable portion and to the valve, the triggering mechanism operable to place the valve in the open state when the openable portion is opened, whereby the compressed gas flows into the interior of the balloon, causing the balloon to inflate.

In another form of the invention a self-triggering inflatable balloon device is disclosed, comprising a box having an openable lid hingedly attached thereto; a container attached to an interior of the box, the container holding a quantity of compressed gas; an inflatable balloon enclosed within the box; a valve coupled to the container and to the balloon, the valve having a closed state and an open state, wherein an interior of the container is placed in fluid communication with an interior of the balloon when the valve is in the open state; and an elongate member having a first end coupled to the lid and a second end coupled to the valve; wherein opening the lid causes a force to be transmitted to the valve through the elongate member, thereby placing the valve in an open state such that the compressed gas flows into the interior of the balloon, causing the balloon to inflate.

DESCRIPTION OF THE PREFERRED EMBODIMENT

Figure 1:
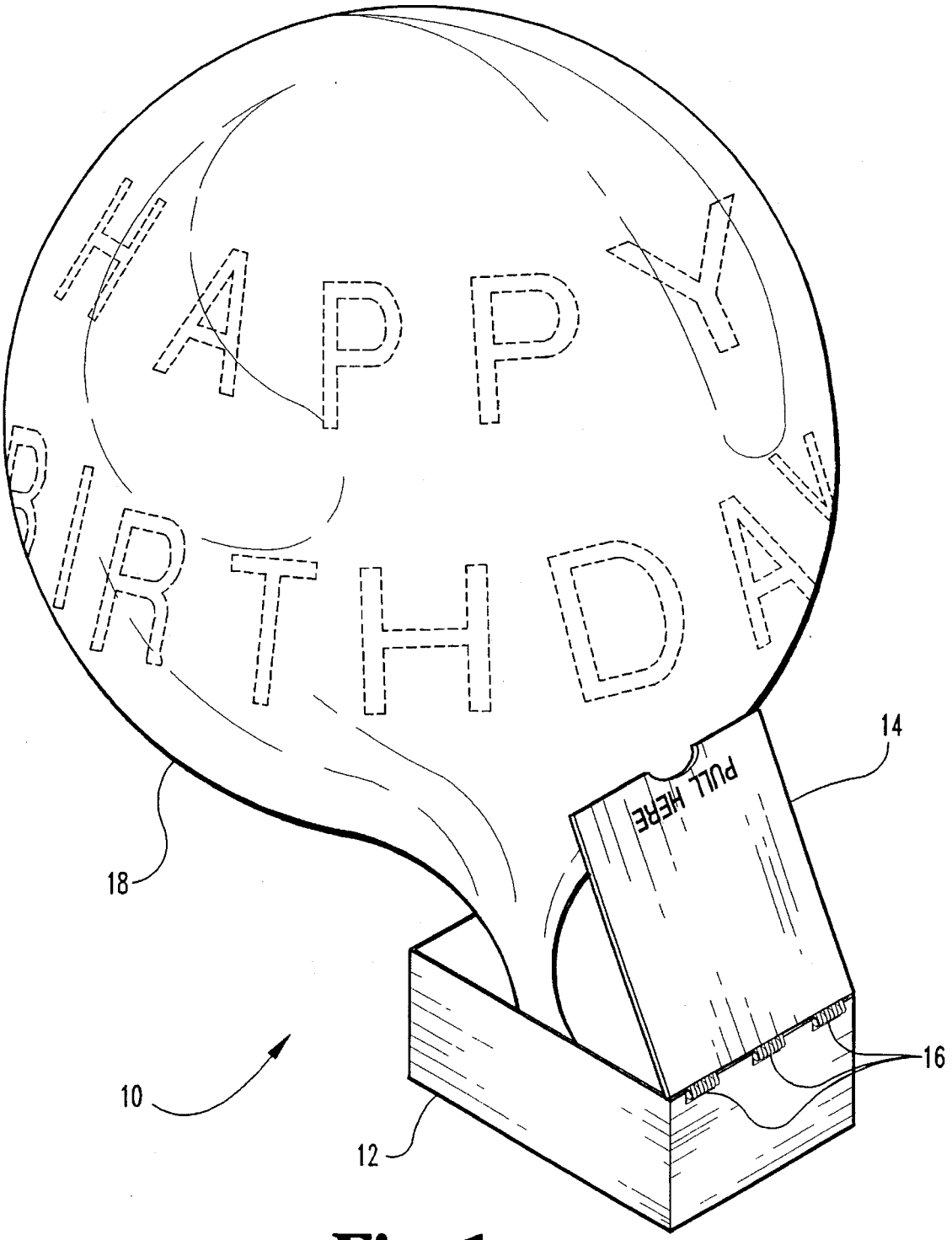
FIG. 1 is perspective view of the present invention, showing the balloon inflated.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is illustrated a preferred embodiment of the self-triggering inflatable balloon device of the present invention, indicated generally at 10. The present invention is completely enclosed in a suitable enclosure, such as a box 12, which may be made of any suitable material, such as cardboard or wood. The box 12 includes an openable portion, such as a lid 14, which is hingedly attached to the box 12 at one end by means of any suitable connection, such as a crease in the cardboard or by means of discreet hinges 16. The lid 14 may optionally include opening instructions thereon, such as the message "PULL HERE". With the lid 14 closed upon the box 12, the present invention may be gift wrapped or mailed to a remote location. When the recipient of the box 12 opens the lid 14, a balloon 18 is caused to be automatically inflated from within the box 12, by means which will be described in greater detail hereinbelow.

It will be appreciated by those skilled in the art that by means of the present invention, a deflated balloon 18 may be enclosed within the box 12 for an indefinite period of time and also mailed to a remote location without substantial risk of damage to the balloon 18. Because the balloon 18 is only inflated upon the lifting of the lid 14, there is no concern that the gas within the balloon 18 will leak therefrom prior to receipt of the balloon 18 by its intended recipient. Furthermore, because the balloon 18 is packaged in a deflated state, the box 12 does not have to be large enough to contain the large and bulky size of the inflated balloon. For this reason, the self-triggering inflatable balloon device 10 of the present invention may be easily stored, wrapped, mailed or transported. It will be further appreciated by those skilled in the art that any suitable message, picture or design may be imprinted onto the balloon 18 in order to convey a message to the recipient. For example, the balloon 18 illustrated in FIG. 1 is imprinted with the words "HAPPY BIRTHDAY" such that a birthday greeting is automatically presented to the recipient upon lifting of the lid 14.

Figure 2:
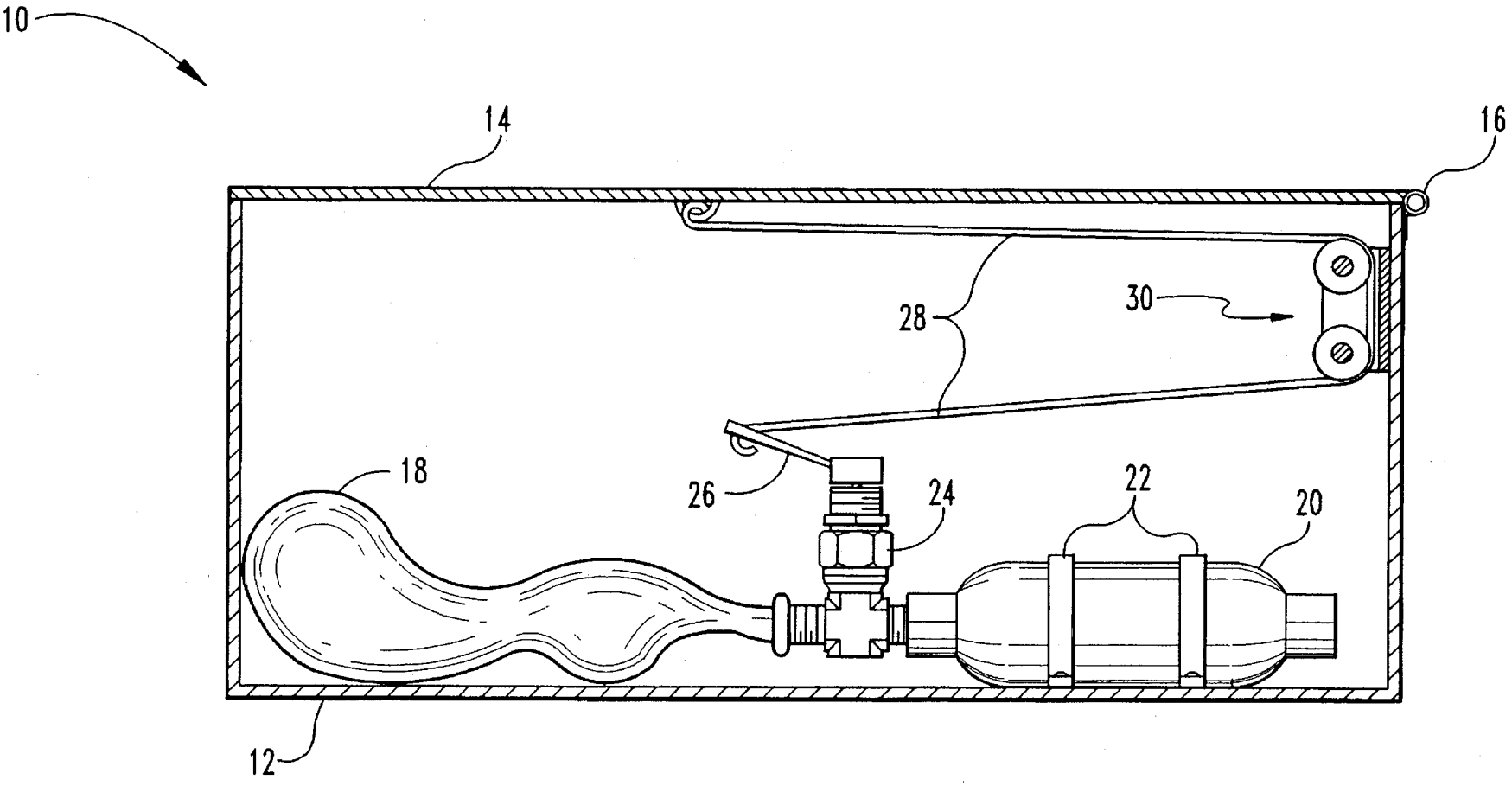
FIG. 2 is a cross-sectional view of the present invention showing the interior of the box with the balloon deflated.

Referring now to FIG. 2, the self-triggering inflatable balloon device of the present invention is illustrated in cross-section. In the view of FIG. 2, the box 12 is shown with the lid 14 closed, and with the balloon 18 in a deflated state.

The device 10 includes a container 20 filled with a compressed gas. In a preferred embodiment of the present invention, the container 20 is a metal cylinder filled with helium gas. However the present invention comprehends the use of any suitable gas, such as carbon dioxide or nitrogen. The cylinder 20 is preferably a part no. 304L-HDF2-40/S40G0000B manufactured by the Whitey Co. of Highland Heights, Ohio. The cylinder 20 is prevented from moving within the box 12 by securing it to the interior thereof by any suitable means, such as by means of U-clips 22.

Gas is prevented from escaping the cylinder 20 by means of a valve 24 connected to an end thereof. The other end of the valve 24 is coupled to an opening in the balloon 18. The present invention comprehends the use of any suitable balloon 18, such as a latex or mylar balloon. The valve 24 includes an actuating handle 26, which maintains the valve 24 in a closed state when in the position shown in FIG. 2. However, rotation of the actuating handle 26 through 90° (in a clockwise direction as viewed in FIG. 2) is operative to place the valve 24 in an open state. In the open state of the valve 24, the compressed gas held within the cylinder 20 is free to flow through the valve 24 and into the balloon 18, thereby expanding the balloon 18. The amount of gas within the cylinder 20 and the pressure thereof is chosen such that the balloon 18 will become substantially fully inflated upon the opening of the valve 24.

Figure 3:
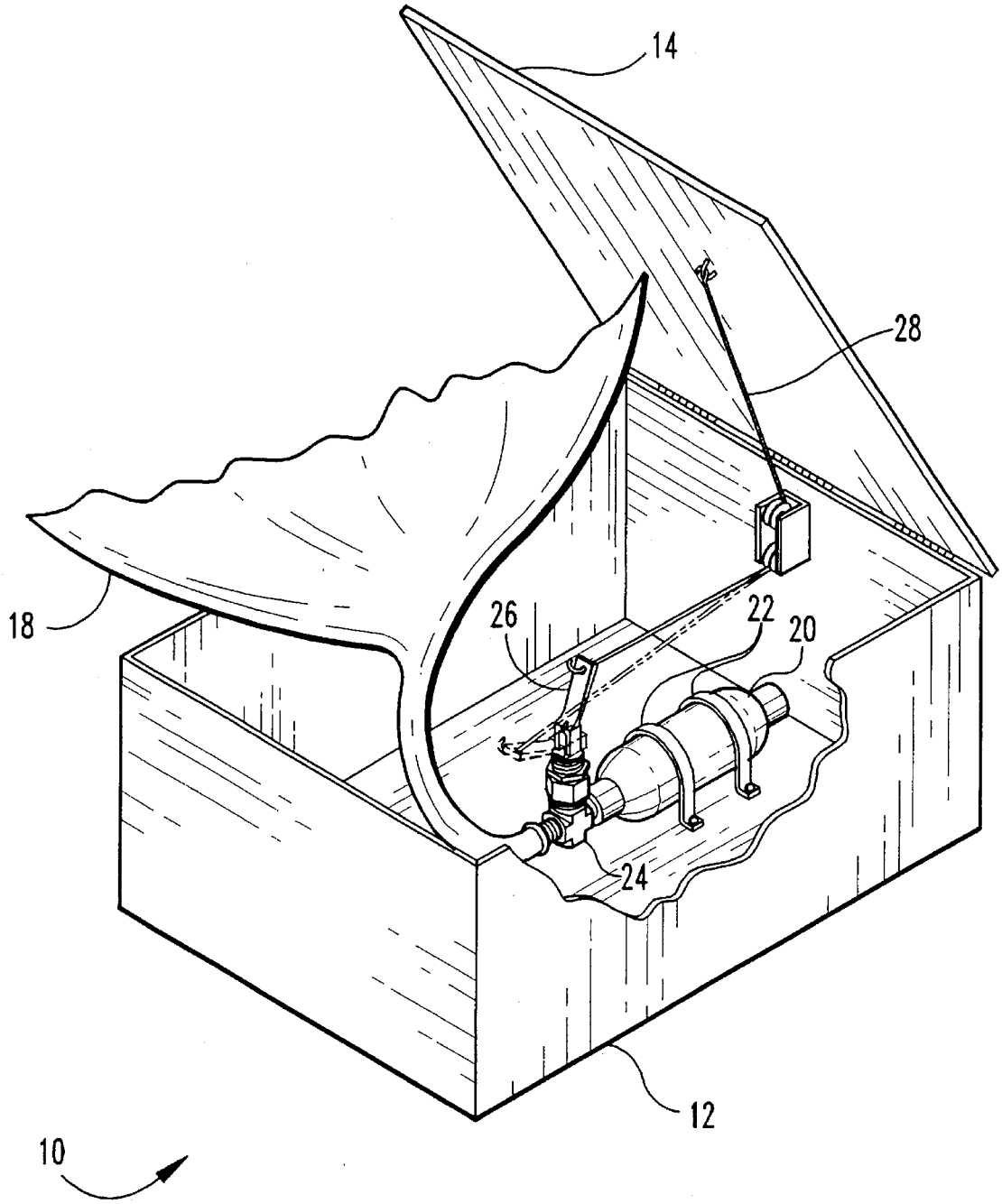
FIG. 3 is a second perspective view of the present invention, showing the interior of the box.

The actuating handle 26 of the valve 24 is coupled to a member 28, such as a wire, string or the like, which is coupled at its other end to the underside of the lid 14. The wire 28 is threaded through an anchor point on the interior of the box 12, such as through the double pulley 30. It will be appreciated by those skilled in the art that when the lid 14 is lifted in a vertical direction, it places tension on the wire 28. This tension is transferred to the actuating handle 26, and causes the actuating handle 26 to be rotated to its open position as the lid 14 is lifted. At this point, the balloon 18 automatically inflates by means of the pressurized gas escaping from within the cylinder 20. Once the balloon inflation process has begun, it cannot be stopped or reversed by attempting to close the lid 14. The self-triggering inflatable balloon device 10 is illustrated in FIG. 3 in its inflated state, the actuating handle 26 of the valve 24 is illustrated in its open state in the view of FIG. 3.

It will be appreciated by those skilled in the art that the self-triggering inflatable balloon device of the present invention offers a significant improvement over the inflatable balloons of the prior art. Because the balloon 18 is maintained in a deflated condition until the balloon is received by the intended recipient, the device 10 may be stored for indefinite periods after purchase without the danger of the inflation gas leaking therefrom. This will allow the device 10 to be purchased well in advance of the occasion for which it was purchased, and will also allow the device 10 to be gift wrapped and presented to the recipient in advance of the time designated for opening the device. Furthermore, because the balloon 18 remains in a compact, uninflated state within the device 10, the device 10 can readily be transported or mailed to a remote location.

It will further will be appreciated by those skilled in the art that various features of the preferred embodiment as disclosed herein may be modified. For example, it is comprehended that the cylinder 20/valve 24 combination may be replaced with a cylinder in which the compressed gas within the cylinder is released when a membrane at the end of the cylinder is punctured. Such an embodiment would require that the opening of the lid 14 caused the membrane of the cylinder to be punctured (by any means as will be apparent to those skilled in the art), thereby inflating the balloon. Also, it is possible that the device 10 be opened in a manner different than lifting the lid 14 which is hingedly attached to the box 12. For example, it is possible to require that the lid of the box 12 be slid open, and thereby actuating the mechanism which causes the compressed gas to inflate the balloon. Furthermore, it is not necessary that the balloon 18 be attached directly to the valve 24. For example, a length of tubing may be coupled between the balloon 18 and the valve 24 in order to allow the balloon 18 to arise farther out of the box 12 once the lid 14 has been raised.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A self-triggering inflatable balloon device, comprising:

an enclosure having an openable portion;

a container enclosed within the enclosure, the container holding a quantity of compressed gas;

an inflatable balloon enclosed within the enclosure;

a triggering mechanism coupled to the openable portion and operable to cause the compressed gas to flow into the balloon when the openable portion is opened, thereby causing the balloon to inflate; and a valve coupled to the container and to the balloon, the valve being operable to place an interior of the container in fluid communication with an interior of the balloon when the valve is in an open position;

wherein the triggering mechanism is further coupled to the valve such that opening of the opening portion causes the valve to assume the open position, thereby placing the interior of the container in fluid communication with the interior of the balloon; and wherein the triggering mechanism comprises an elongate flexible member having a first end coupled to the openable portion and a second end coupled to the valve; and at least one pulley attached to an interior of the enclosure and positioned in rolling engagement with the elongate flexible member.

2. The self-triggering inflatable balloon device of claim 1, wherein the enclosure comprises a cardboard box.

3. The self-triggering inflatable balloon device of claim 2, wherein the openable portion comprises a lid hingedly attached to the cardboard box.

4. The self-triggering inflatable balloon device of claim 1, wherein the container is a hermetically sealed metal cylinder.

5. The self-triggering inflatable balloon device of claim 1, wherein the container is fixedly attached to an interior of the enclosure.

6. The self-triggering inflatable balloon device of claim 1, wherein the compressed gas is helium.

7. The self-triggering inflatable balloon device of claim 1, wherein the inflatable balloon is a latex balloon.

8. The self-triggering inflatable balloon device of claim 1, wherein the elongate flexible member is a wire.

9. A self-triggering inflatable balloon device, comprising:

an enclosure having an openable portion;

a container enclosed within the enclosure, the container holding a quantity of compressed gas;

an inflatable balloon enclosed within the enclosure;

a triggering mechanism coupled to the openable portion and operable to cause the compressed gas to flow into the balloon when the openable portion is opened, thereby causing the balloon to inflate;

an elongate tube having a first end coupled to an opening of the balloon such that an interior of the tube is in fluid communication with an interior of the balloon;

a valve coupled to the container and to a second end of the tube, the valve being operable to place an interior of the container in fluid communication with the interior of the tube when the valve is in an open position;

wherein the triggering mechanism is further coupled to the valve such that opening of the openable portion causes the valve to place the interior of the container in fluid communication with the interior of the balloon; and wherein the triggering mechanism comprises an elongate flexible member having a first end coupled to the openable portion and a second end coupled to the valve; and at least one pulley attached to an interior of the enclosure and positioned in rolling engagement with the elongate flexible member.

* * * * *